United States Patent [19]

Syrek, III

[11] Patent Number: 4,688,793

[45] Date of Patent: Aug. 25, 1987

[54] BACK SAVER

[76] Inventor: Edward J. Syrek, III, 113 Parker St., Manchester, N.H. 03102

[21] Appl. No.: 863,468

[22] Filed: May 15, 1986

[51] Int. Cl.[4] ..... A63B 00/00

[52] U.S. Cl. ..... 272/93; 272/144

[58] Field of Search ..... 128/31, 68, 1, 75, 77, 128/78, 80 R, 80 A, 84 R, 84 C, 85, 87 R, 133, 134; 272/93, 144

[56] References Cited

U.S. PATENT DOCUMENTS

| | | | |
|---|---|---|---|
| 1,452,915 | 4/1923 | Kennedy | 128/84 R |
| 1,812,529 | 6/1931 | Haulbrook et al. | 128/78 |
| 2,191,283 | 2/1940 | Longfellow | 128/88 |
| 2,661,000 | 12/1953 | Gazeley et al. | 128/88 |
| 2,904,039 | 9/1959 | Weissenberg | 128/71 |
| 3,302,641 | 2/1967 | Berne et al. | 128/71 |

*Primary Examiner*—Richard J. Apley
*Assistant Examiner*—J. Welsh
*Attorney, Agent, or Firm*—Hayes, Davis & Soloway

[57] ABSTRACT

A weight-lifting apparatus, for reducing the amount of back injuries, having a chest platform to which thigh supports and telescoping adjustment and locking devices are pivotally connected. The unconnected ends of the thigh supports and the telescoping adjustment and locking devices being connected to one another enabling the thigh supports to pivot relative to the platform and lock the thigh support adjustment at any desired location. The apparatus is further provided with a strapping member to secure the apparatus to the chest-/abdomen portion of a weightlifter.

11 Claims, 3 Drawing Figures

BACK SAVER

BACKGROUND OF THE INVENTION

1. Field of the Invention

This invention relates to the field of weightlifting and more particularly to an apparatus which supports the mid-section of a weightlifter and minimizes the possibility of back injuries when performing various weightlifting exercises.

2. Prior Art

In the past, weightlifters have been exercising their upper bodies without adequate support means for their backs. This has resulted in various back injuries, namely injuries to the lower lumbar vertebrae, the discs, and the spine. The present inventor has found that these injuries can be effectively reduced by properly supporting the back during exercise. The present invention discloses an apparatus which provides proper support during weightlifting.

It is an object of this invention to provide proper support for the back of a weightlifter in order to reduce the possiblity of back injuries.

It is another object of this invention to provide an adjustable back support which allows the weightlifter to adjust the apparatus over a wide range of exercising adjustments.

It is another object of this invention to provide easy, quick and reliable adjustment of the apparatus.

It is a further object of this invention to provide an apparatus which is lightweight and comfortable to wear while performing various weightlifting exercises.

These and other objects of this invention will be apparent to those familiar with the art when the following description is read in conjunction with the drawings.

DETAILED DESCRIPTION OF THE INVENTION

Figure 1:
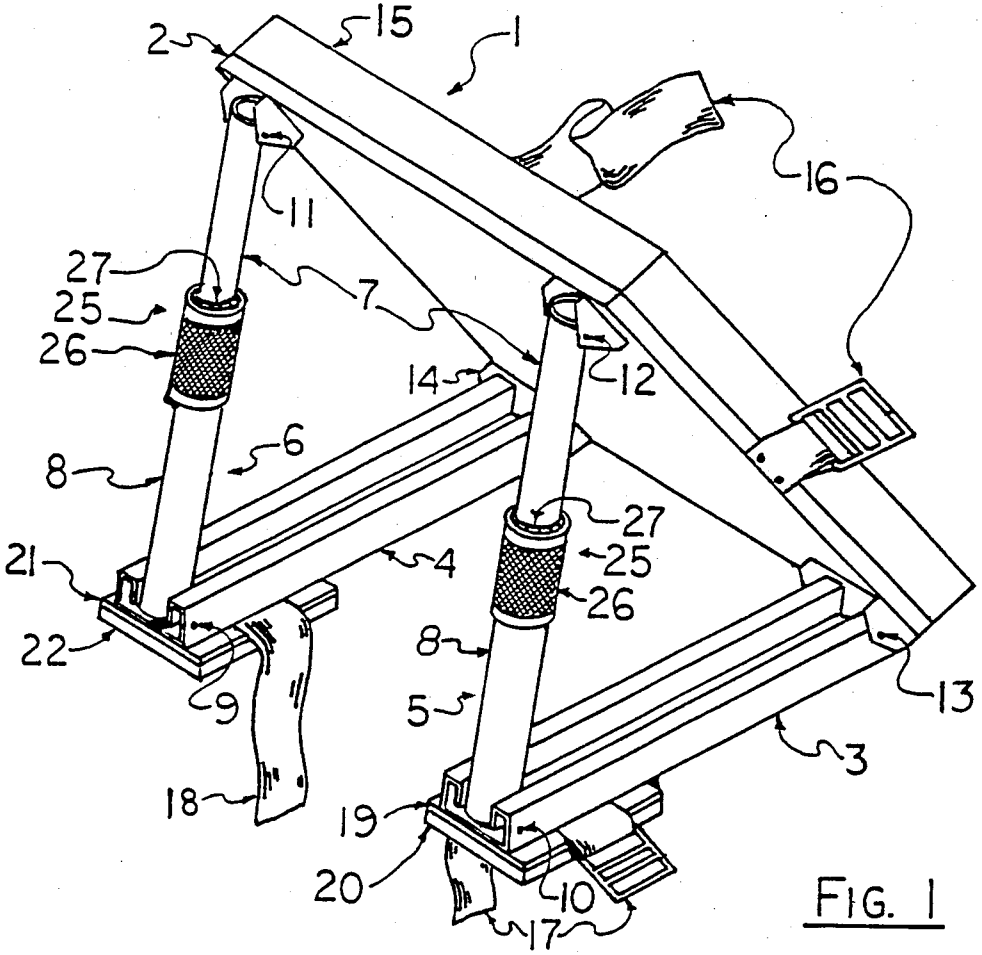
FIG. 1 is a view in perspective of the back saver according to the present invention showing the arrangement of the components relative to each other.

Referring now to FIG. 1, it will be seen that the main structural component of the back saver 1 is a chest platform 2. The depicted shape of which is rectangular, but any desired shape may be utilized so long as the platform area adequately supports the chest/abdomen portion of a weightlifter. Chest platform 2 normally has padded surface 15 affixed to and disposed on the top surface of the chest platform 2. Strapping means 16, which is connected to the side (or bottom) of chest platform 2, firmly secure padded surface 15 of the back saver against the chest/abdomen portion of a weightlifter. Firmly affixed to the bottom side of chest platform 2, adequately spaced apart, in the vicinity of the corners, are hinge mechanisms 11, 12, 13 and 14. The hinge mechanisms provide attachment means for the other back saver components to the bottom side of the chest platform 2. A left thigh support 3 is pivotally attached, at one end thereof, to the hinge mechanism 13 while the second end thereof is connected, by a pin hinge means 10, to an outer leg 8 of a telescoping adjustment unit 5. The second end of telescoping adjustment unit 5, the far end of inner leg 7, is pivotably attached to the hinge mechanism 12. The right thigh support 4 is similarly attached being pivotably connected to chest platform 2 by hinge mechanism 14, at one end thereof, and having its second end pivotably connected by a pin hinge means 9 to an outer leg 8 of a telescoping adjustment unit 6, while the second end of telescoping adjustment unit 6, the far end of inner leg 7, is pivotably connected by a hinge mechanism 11 to the bottom side of chest platform 2.

Both outer telescoping legs 8, at the end surrounding the inner telescoping leg 7, are split tube tapered ends 27 which have a threaded portion to allow a locking hub 26 to be screwed toward the tapered end thus causing the split tube tapered end to frictionally engage with the inner tube.

Thigh support 3 additionally has a thigh platform 19 firmly affixed in the vicinity of the pin hinge means 10 connection, but on the opposite side thereof. Thigh platform 19 has a padded surface 20, which cushions and protects the left thigh of a weightlifter, affixed to the surface of the thigh platform projecting away from the pin hinge means 10 connection. A strapping means 17 is attached to the lower part of the left thigh support 3 and, when connected, securely restrains the left thigh of the weightlifter against padded surface 20. Right thigh support 4 has a similar arrangement whereby a thigh platform 20 is firmly affixed thereto in the vicinity of the pin hinge means 9 connection, but on the opposite side thereof. A padded surface 22 is affixed to the surface of the thigh platform projecting away from the pin hinge means 9 connection. A strapping means 18 securely restrains the right thigh of the weightlifter against padded surface 22.

Although the drawings show that the left and right thigh supports are separate units, it is possible to have them connected together to form one structural unit such as a "tee" shaped configuration.

Figure 3:
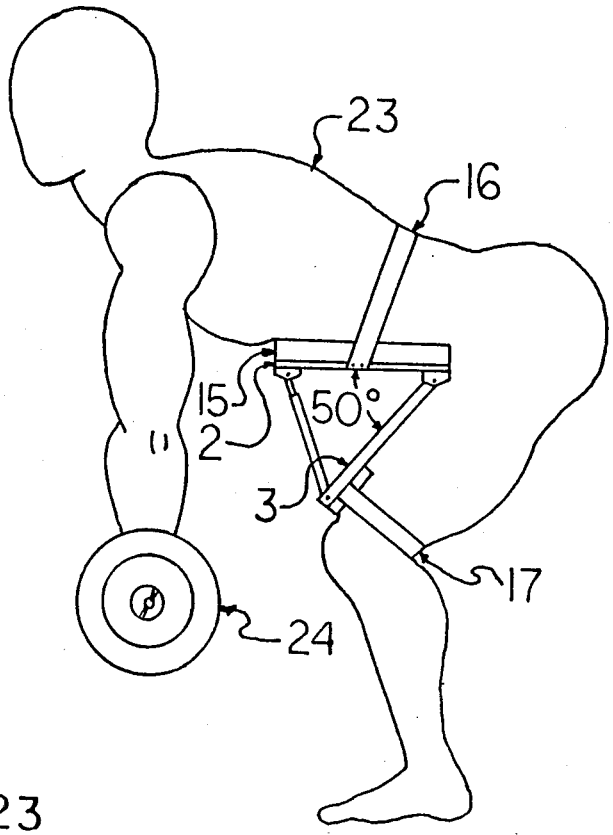
FIG. 3 shows the position of a weightlifter relative to the back saver when the thigh supports are 50° relative to the chest platform.
Figure 2:
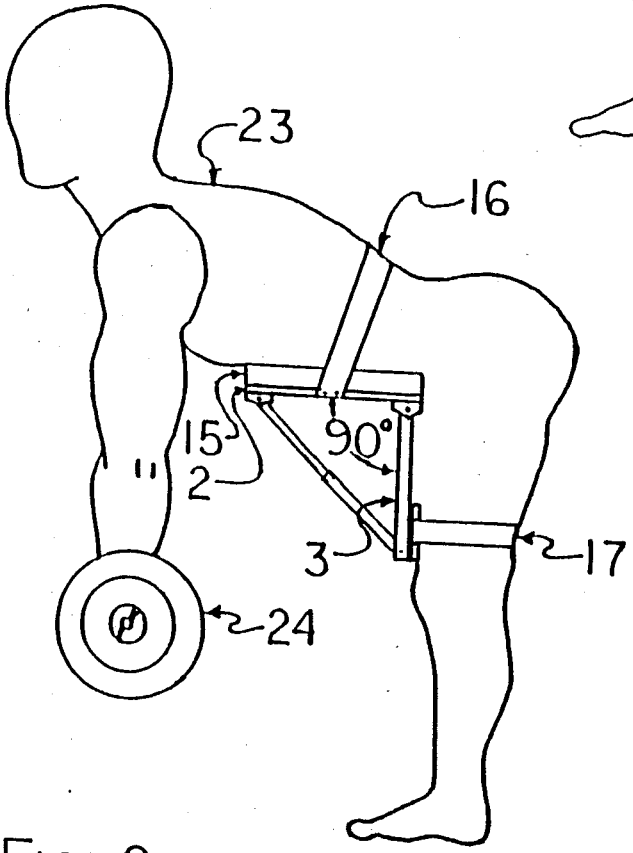
FIG. 2 shows the position of a weightlifter relative to the back saver when the thigh supports are 90° relative to the chest platform.

Referring now to FIGS. 2 and 3, it can be seen that a weightlifter 23 will initially have to position the padded surface 15 of the back saver 1 against his or her chest/abdomen portion. The weightlifter then connects strap means 16 to secure the back saver apparatus to the weightlifter's chest/abdomen area. The weightlifter 23 is then ready to adjust the position of the thigh supports relative to the chest platform 2. The weightlifter rotates both locking means 25 counter clockwise which gradually releases the locking arrangement and enables both inner legs 7 to telescope in or out of both outer legs 8. When the desired adjustment is achieved, both locking means 25 are rotated clockwise thereby locking the desired adjustment. The weightlifter then secures strapping means 17 and 18 to lock the left and right thighs against padded surfaces 22 and 22 of the thigh supports 3 and 4, respectively.

While a screw-type locking means is provided in the embodiment shown, other types of locking means may be also utilized. The important thing is that locking means are provided to lock the thigh supports in a desired arrangement relative to the chest platform.

Once the back saver has been adjusted and strapping means secured, the weightlifter 23 is then ready to commence his weightlifting exercises with a barbell 24, or other similar weightlifting device. When the weightlifter has completed his exercise routine, or desires a break, he can remove the back saver by releasing strapping means 16, 17 and 18.

FIGS. 2 and 3 show the position of a weightlifter relative to the back saver at two different adjustments. FIG. 2 shows the position at a 90 degree angle of the thigh supports relative to the chest platform, while FIG. 3 shows a 50 degree angle of the thigh supports relative to the chest platform 2. The inventor has found that a range from 50 to 90 degrees between these two components is most beneficial. Nevertheless, a greater range of adjustment may be provided without departing from the scope and content of the present invention.

While the fundamental and novel features of the invention have been shown and described, as applied to the preferred embodiment, it will be understood that various omissions, substitutions and changes of the form and details of the device illustrated and in its operation may be made by those skilled in the art, without departing from the spirit and scope of this invention. The embodiment of the invention in which exclusive property and privilege is claimed is defined as follows.

I claim:

1. A portable back saver apparatus comprising:

a chest platform having strapping means, for securing a top surface of the chest platform to an abdomen portion of a weightlifter, and also having first and second hinge means secured to a bottom surface of the platform on opposite ends thereof;

a pair of spaced thigh supports having strapping means, for securing to the thighs of said weight lifter, pivotally connected at a first end thereof to said first hinge means to allow the thigh supports to pivot relative to said chest platform;

telescoping adjustment means pivotally connected at a first end thereof to said second hinge means to allow the adjustment means to pivot relative to said chest platform and being pivotally connected at a second end thereof to a second end of said thigh supports by a pin hinge means; and locking means to lock adjustment of said thigh supports relative to said chest platform at any desired location.

2. An apparatus in accordance with claim 1, wherein a padded surface is affixed to the top surface of said chest platform.

3. An apparatus in accordance with claim 1, wherein both said thigh supports have thigh platforms affixed thereto near the pin hinge means connection but on the opposite side of the thigh supports.

4. An apparatus in accordance with claim 3, wherein both said thigh platforms have padded surfaces affixed thereto on the surface projecting away for the pin hinge means connection.

5. An apparatus in accordance with claim 1, wherein said chest platform is rectangular in shape.

6. A back saver apparatus for use during weightlifting comprising:

a chest platform having a top and a bottom surface wherein strapping means are provided for securing the top surface against an abdomen portion of a weightlifter and the bottom side has first, second, third and fourth hinge means located in extreme areas of the chest platform;

a left thigh support being pivotally connected at one end thereof to said first hinge means;

a left telescoping adjustment means being pivotally connected at one end thereof to said third hinge means while the second thereof is pivotally connected by a hinge pin to a second end of said left thigh support so as to allow the left thigh support to pivot relative to the chest platform;

a right thigh support being pivotally connected at one end thereof to said second hinge means;

a right telescoping adjustment means being pivotally connected at one end thereof to said fourth hinge means while the second thereof is pivotally connected by a second hinge pin to a second end of said right thigh support so as to allow the right thigh support to pivot relative to the chest platform;

left locking means located on the left adjustment means which locks the position of the left thigh supports relative to the chest platform at any desired location; and right locking means located on the right adjustment means which locks the position of the right thigh supports relative to the chest platform at any desired location.

7. An apparatus in accordance with claim 6, wherein a padded surface is affixed to the top surface of said chest platform.

8. An apparatus in accordance with claim 6, wherein both said thigh supports have thigh platforms affixed thereto near the hinge pin connections but on the opposite side thereof.

9. An apparatus in accordance with claim 8, wherein both said thigh platforms have padded surfaces affixed thereto on the surface projecting away for the hinge pin connections.

10. An apparatus in accordance with claim 6, wherein said left and right thigh supports each further include a strapping means which secure the left and right thigh supports against the thighs of a weightlifter.

11. An apparatus in accordance with claim 6, wherein said chest platform is rectangular in shape.

* * * * *